US006838609B2

(12) United States Patent
Shimaya et al.

(10) Patent No.: US 6,838,609 B2
(45) Date of Patent: Jan. 4, 2005

(54) COMMUNICATION SETTING APPARATUS AND METHOD FOR COMMUNICATING TONE PERFORMANCE DATA

(75) Inventors: Hideaki Shimaya, Hamamatsu (JP); Akira Totsuka, Hamamatsu (JP); Tadahiko Ikeya, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/305,839

(22) Filed: Nov. 26, 2002

(65) Prior Publication Data

US 2003/0131718 A1 Jul. 17, 2003

(30) Foreign Application Priority Data

Nov. 30, 2001 (JP) ..... 2001-365999

(51) Int. Cl.[7] ..... G10H 1/18; G10H 7/00
(52) U.S. Cl. ..... 84/615; 84/645
(58) Field of Search ..... 84/615, 645, 653

(56) References Cited

U.S. PATENT DOCUMENTS 5,652,400 A * 7/1997 Fujimori et al. ..... 84/600
5,670,732 A * 9/1997 Utsumi et al. ..... 84/645
5,821,444 A * 10/1998 Yamaura ..... 84/609
6,369,310 B1 * 4/2002 Brunson et al. ..... 84/600
2003/0000368 A1 * 1/2003 Isozaki ..... 84/609

* cited by examiner

*Primary Examiner*—Jeffrey W Donels
(74) *Attorney, Agent, or Firm*—Morrison & Foerster LLP

(57) ABSTRACT

In a memory of a communication setting apparatus, there is stored communication setting information that collectively predefines a plurality of communication condition parameters corresponding to a communication mode. The plurality of communication condition parameters are intended to set whether a plurality of kinds of tone performance data (e.g., tone performance data based on operation on a keyboard and tone performance data based on an automatic performance) and control data (e.g., tempo clock data) should be transmitted or received. When a user has selected a communication mode by operation of a predetermined switch, the communication setting information corresponding to the selected communication mode is read out from the memory, and tone performance data and/or control data are set to condition for transmission or reception in accordance with a plurality of communication condition parameters defined by the communication setting information.

13 Claims, 3 Drawing Sheets

COMMUNICATION SETTING APPARATUS AND METHOD FOR COMMUNICATING TONE PERFORMANCE DATA

BACKGROUND OF THE INVENTION

The present invention relates generally to communication setting apparatus and methods for setting various communication condition parameters necessary for communication (i.e. transmission/reception) of tone performance data and other related data. Particularly, the present invention relates to an improved communication setting apparatus and method which allows a user to promptly set, through simple operation, various communication condition parameters, in a collective fashion, that have to be set for communicating tone performance data between an electronic musical instrument or other device and external equipment.

Typical example of the conventionally-known electronic musical instruments can generate tones not only on the basis of tone performance data (such as MIDI signals) generated by that electronic musical instrument (hereinafter also called an "electronic musical instrument of interest" where necessary), but also on the basis of tone performance data received from external equipment, such as a sequencer, personal computer or other electronic musical instrument, that are connected to the musical instrument of interest. In addition, the electronic musical instrument can also be set so as to transmit tone performance data to external equipment, such as an external tone generator module, personal computer terminal or other musical instrument, connected to the electronic musical instrument of interest so that the connected external equipment can generate tones on the basis of the tone performance data transmitted from the electronic musical instrument of interest. Namely, the typical example of the conventionally-known electronic musical instrument controls itself and the connected external equipment so that either the electronic musical instrument of interest or the connected external equipment can generate tones on the basis of tone performance data communicated as necessary therebetween.

However, in order to control the electronic musical instrument of interest and connected external equipment to allow them to generate tones on the basis of tone performance data and other related data communicated as necessary between the electronic musical instrument of interest and the connected external equipment, it is necessary for the electronic musical instrument to appropriately set various communication condition parameters for establishing conditions for tone performance data communication between the electronic musical instrument and the external equipment. However, the conventional electronic musical instruments are not satisfactory in that it is necessary to individually set a plurality of communication condition parameters and such setting of the communication condition parameters is time-consuming and hence very inefficient. Further, for those users who don't know which of the plurality of communication condition parameters should be set and how such communication condition parameters should be set, it is quite difficult to accurately set the communication condition parameters.

SUMMARY OF THE INVENTION

In view of the foregoing, it is an object of the present invention to provide an improved communication setting apparatus and method for tone performance data communication which allows a user to promptly set communication condition parameters through simple operation.

To accomplish the above-mentioned object, the present invention provides a communication setting apparatus for communicating tone performance data, said communication setting apparatus comprising: a mode selector capable of selecting a communication mode; and a processor coupled with said mode selector and adapted to acquire, in accordance with the communication mode selected via said mode selector, communication setting information that predefines a plurality of communication condition parameters corresponding to the selected communication mode, the plurality of communication condition parameters including at least a parameter for setting whether tone performance data should be transmitted or received, and set tone performance data to condition for transmission or reception in accordance with the plurality of communication condition parameters defined by the communication setting information.

With the communication setting apparatus arranged in the aforementioned manner, the user is allowed to acquire communication setting information, which predefines a plurality of communication condition parameters corresponding to a communication mode, by just selecting the communication mode via the mode selector. In accordance with the plurality of communication condition parameters, various tone performance data and/or control data can be automatically set to condition for being transmitted or received. Thus, by just performing simple operation on the mode selector, the user can promptly set a plurality of communication condition parameters in a collective fashion, which is very convenient to the user.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENTS

Figure 1:
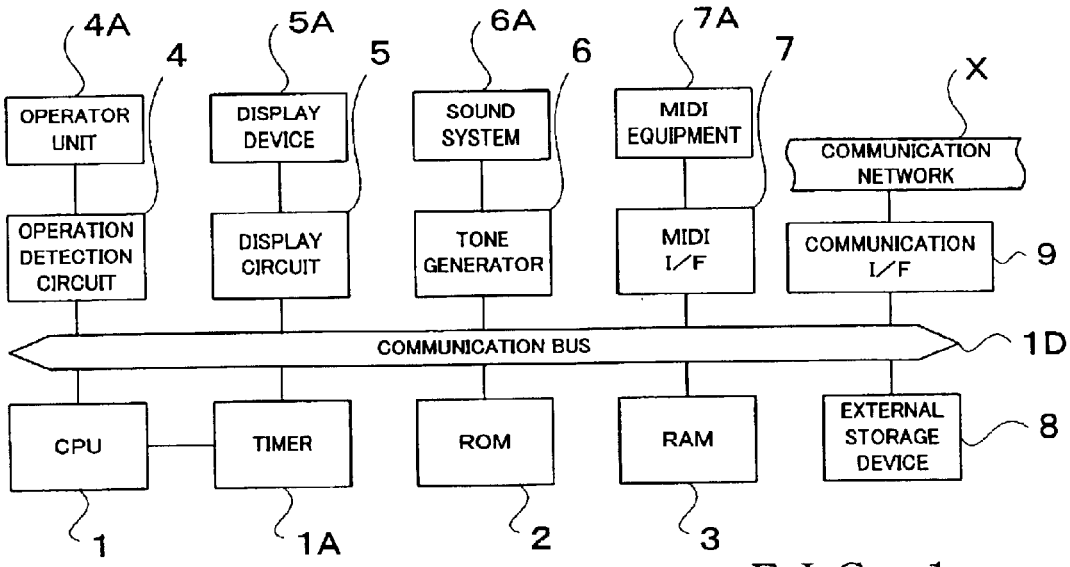
FIG. 1 is a block diagram showing a general hardware setup of an electronic musical instrument having incorporated therein a communication setting apparatus of the present invention.

FIG. 1 is a block diagram showing a general hardware setup of an embodiment of an electronic musical instrument having incorporated therein a communication setting apparatus of the present invention.

The electronic musical instrument, which will be also called an "electronic musical instrument of interest" where necessary to clearly distinguish from an external electronic musical instrument or the like, of FIG. 1 is controlled by a microcomputer comprising a microprocessor unit (CPU) 1, a read-only memory (ROM) 2 and a random-access memory (RAM) 3. The CPU 1 controls all operations of the electronic musical instrument. To the CPU 1 are connected, via a data and address bus ID, the ROM 2, RAM 3, operation detection circuit 4, display circuit 5, tone generator (T.G.) circuit 6, MIDI interface (I/F) 7, external storage device 8 and communication interface (I/F) 9. Also connected to the CPU 1 is a timer 1A for counting various time intervals or periods to, for example, signal interrupt timing for timer interrupt processes. For example, the timer 1A generates clock pulses, which are given to the CPU 1 as processing timing instructions or as interrupt instructions. The CPU 1 carries out various processes in accordance with such instructions.

The ROM 2 has prestored therein various control programs (e.g., programs of later-described main processing and other processing) to be executed by the CPU 1 and various data (e.g., later-described communication setting information) to be referred to by the CPU 1. The RAM 3 is used as a working memory for temporarily storing settings of various communication condition parameters necessary for communication (transmission/reception) of tone performance data between the electronic musical instrument and external MIDI equipment 7A connected via the MIDI interface 7 to the electronic musical instrument, various data generated as the CPU 1 executes a predetermined program, and the like. Further, the RAM 3 is used as a memory for storing a currently-executed program and data related thereto. Predetermined address regions of the RAM 3 are allocated and used as registers, flags, tables, memories, etc.

Operator unit 4A includes a keyboard having a plurality of keys for selecting a pitch of a tone to be generated, and various switches provided on a panel of the body of the electronic musical instrument, such as a communication mode switch for switching an operation mode of the electronic musical instrument between a reproduction mode and a communication mode, and parameter setting switches for manually setting individual communication condition parameters. The reproduction mode is an operation mode in which the electronic musical instrument is allowed to generate a tone on its own, on the basis of tone performance data generated in response to operation on the keyboard, without communicating tone performance data with the external MIDI equipment 7A. The communication mode, on the other hand, is an operation mode in which the electronic musical instrument is allowed to communicate tone performance data with the external MIDI equipment 7A in accordance with predetermined communication setting information so that the electronic musical instrument of interest and/or external MIDI equipment 7A can generate a tone on the basis of the tone performance data. It should be obvious that the operator unit 4A may also include various other operators, such as a numerical-value-data inputting ten-button keypad and text-data inputting keyboard to be used for selecting, setting and controlling a tone pitch, tone color, effect, etc. or a mouse to be used for manipulating a predetermined pointer displayed on a display device 5A. The operation detection circuit 4 constantly detects respective operational states of the individual operators on the operator unit 4A and outputs switch information, corresponding to the detected operational states of the operators, to the CPU 1 via the data and address bus ID. The display circuit 5 visually displays, on the display device 5A that may comprise an LCD (Liquid Crystal Display) and/or CRT (Cathode Ray Tube), various information, such as settings of communication condition parameters, currently-set operation mode (i.e., either the reproduction mode or the communication mode), identifier of communication setting information currently used in the communication mode and a plurality of pieces of communication setting information stored in the ROM 2. The display circuit 5 also displays, on the display device 5A, various performance conditions to be used for reproduction of tone performance data, controlling states of the CPU 1, etc.

The tone generator (T.G.) circuit 6, which is capable of simultaneously generating tone signals in a plurality of channels, receives tone performance data supplied via the data and address bus 1D, and it generates tone signals based on the received tone performance data. Each of the tone signals thus generated by the tone generator circuit 6 is audibly reproduced or sounded by a sound system 6A including amplifiers and speakers. The tone performance data may be either of a digitally coded format like the MIDI format or of a waveform sample data format like the PCM, DPCM or ADPCM format. The tone generator circuit 6 and sound system 6A may be constructed in any conventionally-known manner.

The MIDI interface (I/F) 7 is an interface through which tone performance data based on the MIDI standard (MIDI data) is input from the external MIDI equipment 7A connected to the electronic musical instrument or output to the external MIDI equipment 7A. Specifically, the MIDI interface (I/F) 7 comprises MIDI-IN and MIDI-OUT terminals. Note that the external MIDI equipment 7A may be of any desired type, such as a keyboard type, string instrument type, wind instrument type, percussion instrument type or body-attached type, as long as it can generate MIDI data in response to performance operation by a user or human operator. The MIDI interface 7 may be a general-purpose interface rather than a dedicated MIDI interface, such as RS232-C, USB (Universal Serial Bus) or IEEE1394, in which case other data than MIDI data may be communicated through the MIDI interface 7 along with the MIDI data. In the case where such a general-purpose interface as noted above is used as the MIDI interface 7, the external MIDI equipment 7A may be designed to communicate other data than MIDI data. Of course, the tone performance data handled in the present invention may be of any other data format than the MIDI format, in which case the MIDI interface 7 and external MIDI equipment 7A are constructed in conformity to the data format of the tone performance data.

The external storage device 8 is provided for storing tone performance data generated by operation of the keyboard, tone performance data received from the external MIDI equipment 7A, or data related to control through any of various control programs performed by the CPU 1. In a case where a particular control program is not prestored in the ROM 2, the particular control program may be prestored in the external storage device (e.g., hard disk device) 8, so that, by reading the control program from the external storage device 8 into the RAM 3, the CPU 1 is allowed to operate in exactly the same way as in the case where the particular control program is stored in the program memory 2. This arrangement greatly facilitates version upgrade of the control program, addition of a new control program, etc. The external storage device 8 may use any of various removable-type media other than the hard disk (HD), such as a floppy disk (FD), compact disk (CD-ROM or CD-RAM), magneto-optical disk (MO), digital versatile disk (DVD) and semiconductor memory.

The communication interface (I/F) 9 is connected to a wired or wireless communication network X, such as a LAN (Local Area Network), the Internet or telephone circuit, via which it may be further connected to a desired sever computer (not shown) so as to input a desired control program and various data, such as the above-mentioned communication setting information, to the electronic musical instrument. Thus, in a case where a particular control program and various data are not contained in the ROM 2 or external storage device (hard disk) 8, these control program and data can be downloaded from the server computer via the communication interface 9 to the electronic musical instrument. In such a case, the electronic musical instrument, which is a "client", sends a command requesting the server computer to download the control program and various data by way of the communication interface 9 and communication network X. In response to the command from the client, the server computer delivers the requested control program and data to the electronic musical instrument via the communication network X. The electronic musical instrument receives the control program and data via the communication interface 9 and accumulatively store them into the external storage device (hard disk) 8. In this way, the necessary downloading of the control program and various data is completed. Note that each of the communication interface 9 and communication network X may be of the wireless type rather than the wired type, or of a type capable of both wired and wireless communications.

It should also be appreciated that the electronic musical instrument employing the present invention may be other than the above-described type where the operator unit 4A, display device 5A, tone generator circuit 6, etc. are incorporated together as a unit within the body of the musical instrument, such as a type where the operator unit 4A, display device 5A, tone generator circuit 6, etc. are provided separately and interconnected via communication facilities such as MIDI interfaces, various networks and/or the like. Further, the application of the communication setting apparatus of the invention may be other than to electronic musical instruments; for example, it may be applied to personal computers, portable communication terminals, automatic performance devices, such as karaoke devices and player pianos, game devices, and the like.

Figure 2:
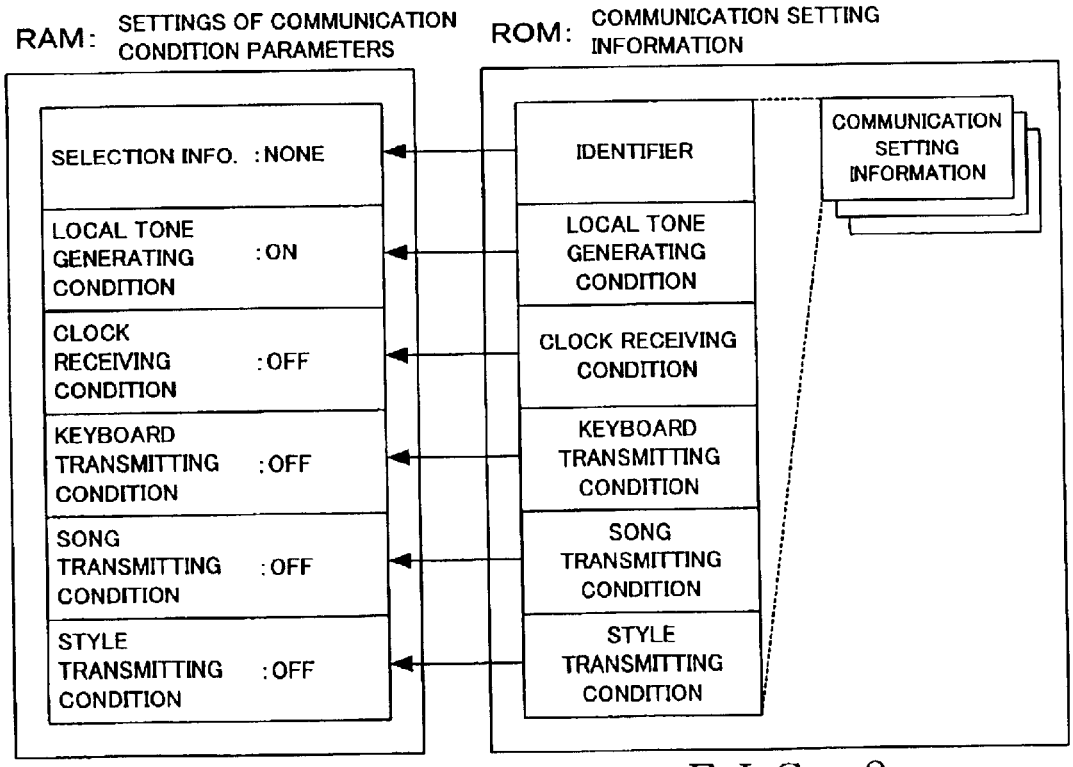
FIG. 2 is a conceptual diagram showing examples of data construction of communication setting information and settings of communication condition parameters.

Now, with reference to FIG. 2, a description will be made about data construction of the above-mentioned communication setting information stored in the ROM 2 and settings of communication condition parameters temporarily stored in the RAM 3.

A plurality of pieces of communication setting information stored in the ROM 2 each define typical settings of communication condition parameters in the electronic musical instrument. Each of the pieces of the communication setting information is imparted with an identifier such as an information name and/or information number, so that the individual pieces of communication setting information can be identified by their respective identifiers. Specifically, each of the pieces of communication setting information defines, as the typical settings of communication condition parameters, a local tone generating condition, clock receiving condition, keyboard transmitting condition, song transmitting condition and style transmitting condition. The above-mentioned local tone generating condition is information to determine whether or not tone performance data generated by the electronic musical instrument should be transmitted to the tone generator circuit 6 within the electronic musical instrument. The clock receiving condition is information to determine whether or not clock signals received from external equipment by the electronic musical instrument should be used as clock signals for an automatic performance. The keyboard transmitting condition is information to determine whether or not tone performance data generated by operation on the keyboard of the electronic musical instrument should be transmitted to external equipment (i.e. outside the electronic musical instrument). The song transmitting condition and style transmitting condition are each information related to transmission and reception of automatic performance data; specifically, the song transmitting condition is information to determine whether or not tone performance data generated by reproduction of a song by the electronic musical instrument should be transmitted to external equipment, while the style transmitting condition is information to determine whether or not tone performance data generated by reproduction of a style by the electronic musical instrument should be transmitted to external equipment.

Settings of communication condition parameters buffered in the RAM 3, on the other hand, indicate current settings of various communication condition parameters. On the basis of the current communication condition parameter settings, the electronic musical instrument of interest controls its various internal components and external MIDI equipment 7A and the like (hereinafter simply called "external equipment") and communicate tone performance data between any one of the internal components and the external equipment as necessary. Namely, behavior of the electronic musical instrument and external equipment is determined in accordance with the current parameter settings buffered in the RAM 3. For example, when the current setting of at least one of the keyboard transmitting condition, song transmitting condition and style transmitting condition is "ON" (instructing "transmission of tone performance data"), the electronic musical instrument transmits only tone performance data, generated by the currently-ON transmission option, to external equipment such as a personal computer, tone generator module or sequencer. The external equipment audibly reproduces or sounds the tone performance data, received from the electronic musical instrument of interest, by means of its tone generator system, or transmits the received tone performance data back to the electronic musical instrument together with tone performance data generated by manual and automatic performances executed in the external equipment and/or tone performance data received from another device connected to the external equipment. For example, the tone performance data received from the electronic musical instrument are mixed with tone performance data generated by manual and automatic performances executed in the external equipment and/or tone performance data received from another device connected to the external equipment are mixed together, and the thus-mixed tone performance data are sent back, i.e. echoed back, to the electronic musical instrument. The communication condition parameter settings buffer is rewritten in response to operation of the communication mode switch. Namely, any one of the pieces of communication setting information stored in the ROM 2 is read out in response to operation of the communication mode switch, and contents of the thus read-out communication setting information are registered in the communication condition parameter settings buffer. For example, the settings of the communication condition parameters, where only the local tone generation is set to ON as the reproduction mode, are rewritten in accordance with the communication setting information read out in response to the operation of the communication mode switch, and the thus-rewritten settings of the communication condition parameters are used as settings for the communication mode.

Figure 3:
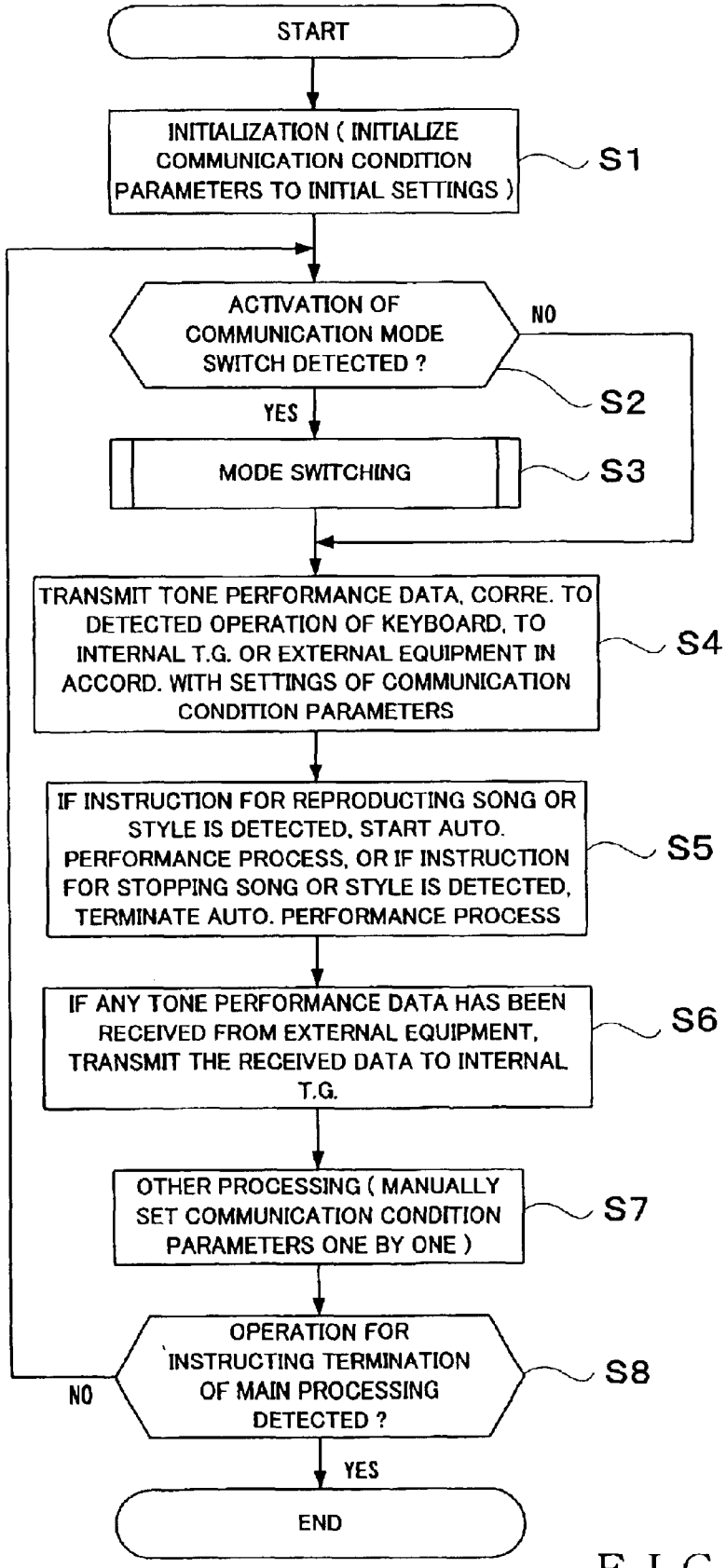
FIG. 3 is a flow chart showing an example of main processing.

As stated above, with the electronic musical instrument shown in FIG. 1, it is possible to easily set different sets of communication condition parameters corresponding to the reproduction and communication modes, by just operating the communication mode switch. Therefore, a detailed description will be made hereinbelow about a communication condition parameter setting process carried out in response to mode switching by operation of the communication mode switch. FIG. 3 is a flow chart showing an example of main processing performed by the CPU 1 in the electronic musical instrument shown in FIG. 1. The main processing is repetitively performed from a time when the power supply to the electronic musical instrument is turned on to a time when the power supply is turned off.

At step S1, a predetermined initialization process is performed. For example, in the initialization process, the electronic musical instrument is set to the reproduction mode, and the communication condition parameters are initialized to initial settings (see a left block of FIG. 2). At step S2, a determination is made as to whether operation, by the user, of the communication mode switch has been detected. If operation of the communication mode switch has been detected (YES determination of FIG. 2), a mode switching process is carried out at step S3 as will be later described in detail. At step S4, detection is made of operation on the keyboard of the electronic musical instrument, and tone performance data corresponding to the keyboard operation are transmitted to the internal tone generator (T.G.) (i.e., tone generator circuit 6 of the electronic musical instrument) or external equipment in accordance with the settings of the communication condition parameters. When the local tone generating condition is currently set to "ON", the tone performance data corresponding to the detected keyboard operation are transmitted to the internal tone generator, while the keyboard transmitting condition is currently set to "ON", the generated tone performance data are transmitted to the external equipment. When the tone performance data are to be transmitted to the external equipment, the tone performance data can be transmitted on a part-by-part basis (per performance part) by designating MIDI channels.

Once an instruction for reproducing a song or style is detected in the electronic musical instrument, an automatic performance process is started up in the musical instrument at step S5. Conversely, when an instruction for stopping a song or style is detected in the electronic musical instrument, the automatic performance process is terminated at step S5. The automatic performance process (not shown), started or terminated at step S5, is an interrupt process that is triggered per generation cycle of one of the clock signal generated within the electronic musical instrument (i.e., clock signal used when the clock receiving condition is OFF) and the clock signal received from the external equipment (i.e., clock signal used when the clock receiving condition is ON). In the automatic performance process, tone performance data to be processed at current clock timing is read out and transmitted to the internal tone generator or external equipment depending on the communication condition parameter settings, in a similar manner to step S4. In this case too, the tone performance data can be transmitted on the part-by-part basis by designating MIDI channels. At step S6, when any tone performance data has been received from the external equipment, the received tone performance data is transmitted to the internal tone generator (T.G.). At following step S7, there are performed an operation for manually setting communication condition parameters one by one, other processing to be described below, etc. When communication condition parameters have been set manually, i.e. when operation for changing the communication condition parameters using various operators has been detected, the contents of the communication condition parameter settings buffer are rewritten in accordance with that operation for changing the communication condition parameters. At step S8, a determination is made as to whether operation for instructing termination of the main processing has been detected or not. If such operation for instructing termination of the main processing has been detected, i.e. if the electronic musical instrument has been turned off (YES determination of step S8), the main processing is brought to an end. If no such operation for instructing termination of the main processing has been detected (NO determination of step S8), the processing reverts to step S2 to repeat the above-described operations of steps S2 to S7.

Figure 4:
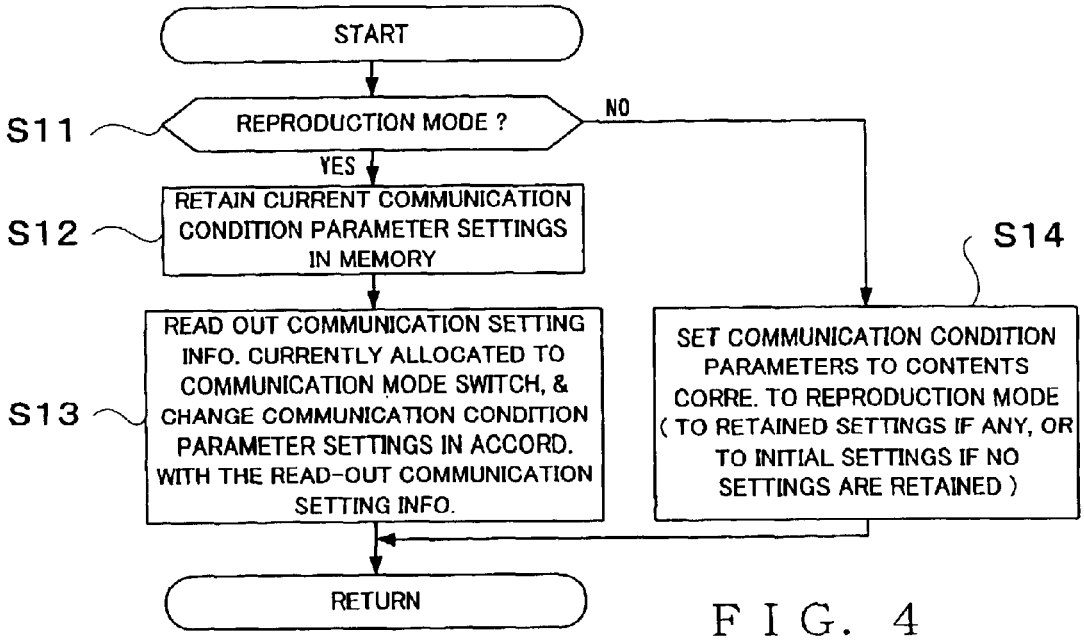
FIG. 4 is a flow chart showing an example of a mode switching process.

The following paragraphs describe a mode switching process carried out at step S3 of the main processing, with reference to FIG. 4 that is a flow chart showing an example of the mode switching process.

At step S11, it is determined whether or not the currently-set operation mode is the reproduction mode. If the currently-set operation mode is the reproduction mode, namely, if the communication mode switch has been operated to switch from the reproduction mode to the communication mode (YES determination of step S11), the current communication condition parameter settings are retained in a predetermined memory area at step S12. Then, communication setting information currently allocated to the communication mode switch is read out, and the communication condition parameter settings are changed, at step S13, in accordance with the thus read-out communication setting information. Namely, when the communication mode switch has been operated to switch the operation mode to the communication mode, a predetermined piece of communication setting information is read out from among the plurality of pieces of communication setting information stored in the ROM 2, and the communication condition parameter settings buffer is automatically rewritten in accordance with ON/OFF settings of individual communication condition parameters pre-defined in the read-out communication setting information. For example, by the user merely operating the communication mode switch to set the electronic musical instrument to the communication mode, the contents of the communication condition parameter settings buffer, where the local tone generation parameter (i.e., local tone generating condition) is set at "ON" and other communication condition parameters are set at "OFF", are collectively rewritten so that the local tone generating condition is set to "OFF" and other communication condition parameters are set to "ON". At that time, a message that the currently-selected operation mode of the electronic musical instrument is the "communication mode" is displayed on the display device 5A; conversely, when the reproduction mode has been selected, a message that the currently-selected operation mode of the electronic musical instrument is the reproduction mode is displayed on the display device 5A. The identifier of the read-out communication setting information is also displayed on the display device 5A to allow the user to see which of the pieces of the communication setting information is being used in the communication mode. Of course, the display device 5A displays the current setting of each of the communication condition parameters, other than the current operation mode and identifier of the read-out communication setting information.

On the other hand, if the currently-selected operation mode is not the reproduction mode, i.e. if the communication mode switch has been operated to switch from the communication mode to the reproduction mode (NO determination of step S11), the communication condition parameters are set or changed to contents corresponding to the reproduction mode, at step S14. When thus setting the communication condition parameters to contents corresponding to the reproduction mode, the communication condition parameters are set to the settings currently retained in the predetermined memory area, if any; however, in case no settings are currently retained in the predetermined memory area, initial settings are set as the contents corresponding to the reproduction mode. Whereas the instant embodiment has been described above as retaining the settings of the communication condition parameters having been used up to an operation mode change (see step S12), it is not always necessary to retain the settings of the communication condition parameters. In the case where the settings of the communication condition parameters before an operation mode change are not retained, the communication condition parameters are always set to the initial settings (see FIG. 14). In this way, the operation mode of the electronic musical instrument is switched alternately between the reproduction mode and the communication mode each time the communication mode switch is depressed, and the settings of the communication condition parameters are rewritten in response to such operation mode switching.

Figure 5A:
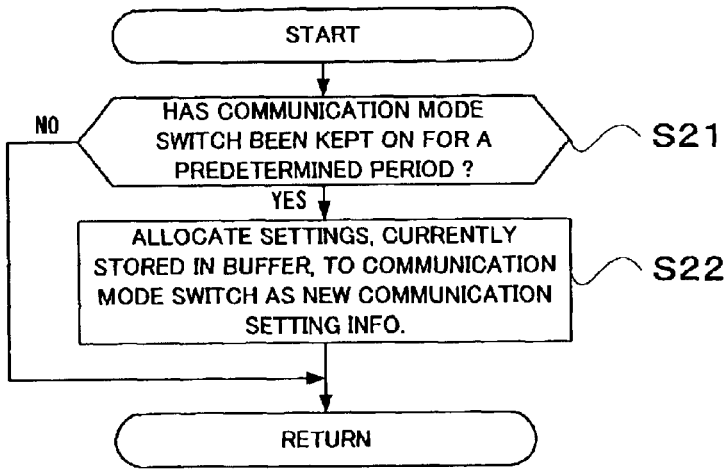
FIG. 5 is a flow chart showing an example of other processing.
Figure 5B:
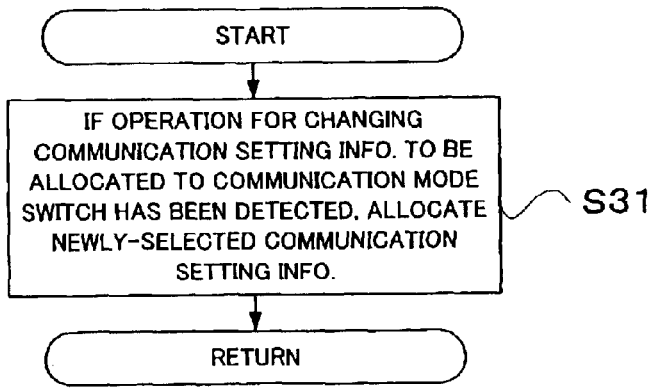

The following paragraphs describe the "other processing" performed at step S7 of the above-described main processing, with reference to FIGS. 5A and 5B that are flow charts showing exemplary step sequences of the other processing. Specifically, FIG. 5A shows a registration process for registering the contents of the settings buffer as new setting information, and FIG. 5B shows a change process for changing communication setting information to be allocated to the communication mode switch.

First, in the registration process of FIG. 5A, it is determined at step S21 whether the communication mode switch has been kept ON for a predetermined period of time. If the communication mode switch has been kept ON for the predetermined period of time (YES determination of step S21), the settings currently stored in the communication condition parameter settings buffer are allocated to the communication mode switch as new communication setting information, at step S22. Thus, in the case where the user sets the communication condition parameters one by one (see step S7 of FIG. 4), the settings of the individual communication condition parameters are registered as new communication setting information (user information) so that they can be read out as the operation mode of the electronic musical instrument is set to the communication mode. Next, in the change process of FIG. 5B, when operation for changing the communication setting information to be allocated to the communication mode switch has been detected, the changed or newly-selected communication setting information is allocated to the communication mode switch, at step S31. In this way, user desired communication setting information can be used when the settings of the individual communication condition parameters are to be rewritten by activation of the communication mode switch.

In a modification, there may be provided a plurality of communication mode switches so as to allocate different sets of communication settings to the communication mode switches. Further, arrangements may be made such that the echo back function of the external equipment can be set compulsorily by the electronic musical instrument transmitting, to the external equipment, information for turning on/off the echo back function of the external equipment. Note that the operation for recording the settings of the communication condition parameters as new communication setting information and the operation for allocating the thus-recorded communication setting information to the communication mode switch (see step S22 of FIG. 5A) may be other than prolonged depression of the communication mode switch for more than a predetermined period of time; for example, another special switch (e.g., decision switch) may be used to record the settings of the communication condition parameters as new communication setting information or allocate the thus-recorded communication setting information to the communication mode switch. It should be appreciated that the data to be communicated between the electronic musical instrument and the external equipment are not necessarily limited to MIDI data.

In summary, the present invention having been described above is characterized by collectively setting a plurality of communication condition parameters on the basis of communication setting information read out in response to operation of the communication mode switch. With such an arrangement, the user is allowed to promptly set communication condition parameters through simple operation.

The present invention relates to the subject matter of Japanese Patent Application No. 2001-365999 filed on Nov. 30, 2001, the disclosure of which is expressly incorporated herein by reference in its entirety.

What is claimed is:

1. A communication setting apparatus for communicating tone performance data, said communication setting apparatus comprising:

a mode selector capable of selecting a communication mode at any desired time point while a power supply is ON; and a processor coupled with said mode selector and adapted to:

upon selection of the communication mode via said mode selector, acquire, in accordance with the communication mode selected via said mode selector, communication setting information that predefines a plurality of communication condition parameters corresponding to the selected communication mode, the plurality of communication condition parameters including parameters for setting conditions for tone performance data transmission and/or reception;

collectively set conditions for tone performance; and data transmission and/or reception in accordance with the plurality of communication condition parameters defined by the communication setting information.

2. A communication setting apparatus as claimed in claim 1 wherein the plurality of communication condition parameters include the parameter for setting whether tone performance data should be transmitted or received, for each of a plurality of kinds of tone performance data including tone performance data based on operation on a keyboard and tone performance data based on an automatic performance.

3. A communication setting apparatus as claimed in claim 2 wherein the tone performance data based on an automatic performance include song data and style data.

4. A communication setting apparatus as claimed in claim 1 wherein the plurality of communication condition parameters further include tone performance control data.

5. A communication setting apparatus as claimed in claim 1 wherein said processor includes a storage device storing communication setting information that predefines a plurality of communication condition parameters corresponding to at least one communication mode, and the communication setting information is read out from said storage device in accordance with the communication mode selected via said mode selector.

6. A communication setting apparatus as claimed in claim 1 wherein said mode selector is capable of selecting any one of the at least one communication mode and a reproduction mode, and the reproduction mode is a mode where communication of tone performance data is not carried out.

7. A communication setting apparatus as claimed in claim 6 which further comprises:

an operator that is manually operated to set contents of the plurality of communication condition parameters, the condition for transmission or reception of said tone performance data set by said processor being modified in accordance with the contents of the plurality of communication condition parameters set via said operator, and wherein said processor is further adapted to:

retain the contents of the plurality of communication condition parameters, set via said operator, in a memory, when the mode selected by said mode selector is switched from the reproduction mode to the communication mode; and restore the contents of the plurality of communication condition parameters, retained in said memory, to set said tone performance data to condition for transmission or reception in accordance with the restored contents, when the mode selected by said mode selector is switched from the communication mode to the reproduction mode.

8. A communication setting apparatus as claimed in claim 6 wherein said processor is further adapted to:

set, as defaults, the contents of the plurality of communication condition parameters in the reproduction mode; and restore the contents of the plurality of communication condition parameters, having been set as defaults, to set said tone performance data to condition for transmission or reception in accordance with the restored contents, when the mode selected by said mode selector is switched from the communication mode to the reproduction mode.

9. A communication setting apparatus as claimed in claim 1 wherein said mode selector comprises a mode selecting switch provided on an operation panel.

10. A communication setting apparatus as claimed in claim 1 which further comprises a storage section that stores a plurality of sets of communication setting information, and an information selector that selects any one of the sets of communication setting information stored in said storage section.

11. A communication setting apparatus as claimed in claim 10 wherein said processor is further adapted to:

allocate the one set of communication setting information, selected by said information selector, to a communication mode selectable via said mode selector; and read out the one set of communication setting information, allocated to the communication mode selected via said mode selector, from said storage section, to thereby acquire the one set of communication setting information.

12. A method for communicating tone performance data comprising:

selecting a communication mode at any desired time point while a power supply is ON;

upon selection of the communication mode, acquiring, in accordance with the communication mode selected by the step of selecting, communication setting information that predefines a plurality of communication condition parameters corresponding to the selected communication mode, the plurality of communication condition parameters including parameters for setting conditions for tone performance data transmission and/or reception;

collectively setting conditions for tone and performance data transmission and/or reception in accordance with the plurality of communication condition parameters defined by the communication setting information acquired by the step of acquiring.

13. A computer program containing a group of instructions to cause a computer to perform a method for communicating tone performance data, said method comprising:

selecting a communication mode at any desired time point while a power supply is ON;

upon selection of the communication mode, acquiring, in accordance with the communication mode selected by the step of selecting, communication setting information that predefines a plurality of communication condition parameters corresponding to the selected communication mode, the plurality of communication condition parameters including parameters for setting conditions for tone performance data transmission and/or reception;

collectively setting conditions for tone and performance data transmission and/or reception in accordance with the plurality of communication condition parameters defined by the communication setting information acquired by the step of acquiring.

* * * * *

UNITED STATES PATENT AND TRADEMARK OFFICE

CERTIFICATE OF CORRECTION

PATENT NO. : 6,838,609 B2
DATED : January 4, 2005
INVENTOR(S) : Hideaki Shimaya et al.

It is certified that error appears in the above-identified patent and that said Letters Patent is hereby corrected as shown below:

Column 10,
Line 56, should read -- transmission and/or reception --; and
Line 57, should read -- collectively set conditions for tone performance --;

Column 12,
Lines 31 and 50, should read -- or reception --.

Signed and Sealed this

Nineteenth Day of April, 2005

JON W. DUDAS
*Director of the United States Patent and Trademark Office*